United States Patent [19]

Levy

[11] 4,107,639

[45] Aug. 15, 1978

[54] CARTRIDGE FUSE INJECTOR AND EJECTOR

[75] Inventor: Ralph M. Levy, Abington, Pa.

[73] Assignee: Honeywell Inc., Minneapolis, Minn.

[21] Appl. No.: 656,886

[22] Filed: Feb. 10, 1976

[51] Int. Cl.[2] ..... H01H 85/22

[52] U.S. Cl. ..... 337/205; 337/211; 339/45 R

[58] Field of Search ..... 337/190, 194, 196, 200, 337/205, 208, 211, 237, 264; 339/45 R, 45 M, 241; 335/202; 317/114, 116

[56] References Cited

U.S. PATENT DOCUMENTS

| | | | |
|---|---|---|---|
| 1,007,802 | 11/1911 | Sachs | 337/205 |
| 2,783,331 | 2/1957 | Sundt | 337/211 |
| 2,907,849 | 10/1959 | Kobryner | 337/211 |
| 3,418,615 | 12/1968 | Canney | 337/205 |
| 3,896,408 | 7/1975 | Leidy | 337/211 |

FOREIGN PATENT DOCUMENTS

| | | | |
|---|---|---|---|
| 1,203,956 | 1/1960 | France | 337/211 |
| 1,963,648 | 6/1971 | Fed. Rep. of Germany | 337/201 |

*Primary Examiner*—Harold Broome

*Attorney, Agent, or Firm*—Laurence J. Marhoefer; Lockwood D. Burton; Mitchell J. Halista

[57] ABSTRACT

A combination fuse injector and ejector for cartridge type fuses includes a molded plastic open top receptacle, or shroud, having protective peripheral walls, a bottom wall and a hinged cover. The bottom wall includes an opening adjacent each end of the receptacle through which conventional fuse holding contact clips rigidly attached to a mounting surface can enter the receptacle. The bottom wall includes an integral external pedestal which provides a loosely coupled captive mounting for the receptacle on the mounting surface. The bottom wall of the shroud also includes a fuse-ejecting internal surface extending between the pair of contact clips whereby the fuse may be ejected from the clips by a lifting of the shroud on its loosely captive pedestal. The cover includes an integral class for lightly gripping the fuse to retain it during the ejection operation and to accept a replacement fuse for injection into the clips. The cover with the replacement fuse held in the claw is closed on the shroud and the entire assembly is returned to a mounted position on the mounting surface whereby the fuse is forced into the mounting clips.

13 Claims, 3 Drawing Figures

CARTRIDGE FUSE INJECTOR AND EJECTOR

CROSS REFERENCE TO RELATED APPLICATIONS

Subject matter shown and described but not claimed herein is shown, described and claimed in a copending application of Ralph M. Levy, Ser. No. 438,369, filed on Jan. 31, 1974, now abandoned, and assigned to the same assignee as the present application.

BACKGROUND OF THE INVENTION

1. Field Of The Invention

This invention relates to an improved fuse ejector and, more particularly, to a fuse ejector and injector for cartridge type fuses.

2. Description Of The Prior Art

Many different types of devices have been proposed in the prior art for inserting cartridge type fuses into and/or ejecting such fuses from conventional fuse retaining spring clips mounted in a fixed spaced apart relationship on a fuse support, such as a printed circuit, or PC, board. One such known device employes a "dedicated" plastic tool having finger gripping portions at one end and a C-shaped fuse holder configuration at its other end. Such a tool must first have its C-shaped end forced over an end of the unmounted fuse and subsequently positioned on a center portion of the fuse. The fuse may then be mounted in the customary manner in the spaced spring clips by gripping the tool at the finger gripping portions and forcing the ends of the fuse into a support relationship with the spring clips. In order to remove the installed fuse from its supporting clips, a fuse removing force may be applied by grasping the tool at the finger portions and pulling against the restraining force of the clips until the fuse is free of the clips. Such a tool is, at best, inconvenient to use. Additionally, because of slippage between the tool and the body of the fuse, difficulty has been experienced in inserting the fuse properly between the spaced clip contacts.

The use of unshrouded or unprotected fuse holders, or clips, poses a shock hazard for one servicing equipment employing such exposed fuse holders either when a fuse is inserted or removed or in the event of accidental contact during a servicing operation because of the exposed electrically "live" surfaces of the fuse clips.

In order to prevent such a shock hazard, it has been proposed in the prior art to provide a protective shroud around the fuse clips in the form of an electrically nonconductive U-shaped shell having its base portion mounted rigidly on the associated fuse mounting support. The sides of the shell are arranged to surround the fuse and the spring clips and to extend generally perpendicularly away from the shell base to a height coextensive with the spring clips. Centrally located open slots formed in the sides of the shell enable the fuse to be grasped by the central portion of the fuse when it is desired to insert or remove a fuse from the spring clip contacts.

While such a shroud provides a measure of protection from accidental contact with the fuse clips there is still the possibility that the fuse will be damaged by a mechanical tool such as a screwdriver which is often used in lieu of a proper tool, to force the fuse into or out of its clip engaging position. Since a significant force is required to remove cartridge type fuses from the clips retaining them, the fuses sometimes unexpectedly pop out of the fuse clips and fly into the face of the person employing an improper tool such as a screwdriver to remove them.

There are other prior art fuse pullers in the form of electrically insulating pliers which are employed to grip the fuse and to remove or to insert it with respect to the clips. The inherent problem with such devices is that the tool must be handy when it is desired to change fuses and adequate clearance must be provided for manuvering the tool in the vicinity of the fuse.

A combined fuse shroud and puller, or ejector, is shown in U.S. Pat. No. 3,896,408 which is assigned to the same assignee as the present application. The structure of this puller includes an open top, electrically insulating receptacle surrounding the fuse and the spring clips. The bottom of the receptacle has two openings through which the fuse clips can protrude. A pedestal is attached to the outside surface of the bottom of the receptacle and is arranged to pass through a hole in a mounting board. The free end of the pedestal is provided with a pair of ears to inhibit complete withdrawal of the pedestal from the hole. The inside surface of the bottom of the receptacle is provided with ramp surface sloping away from the inside surface toward one of the fuse clips. When the shroud is moved away from the mounting board to the extend permited by the ears on the pedestal, the ramp surface bears against the fuse and forces it out of one of the spring clips. The fuse can then be extracted from the shroud and the remaining fuse clip. However, the subsequent extraction from the remaining spring clip is difficult to perform within the confines of the shroud. Further, the clips and fuse ends are still exposed through the open top of the shroud which affords the possibility of accidental contact therewith. Finally, the insertion of a replacement fuse is not assisted by this fuse puller and is achieved only by a manual handling of the fuse within the shroud body which operation could pose a shock hazard if the fuse clips have been left electrically "live".

Accordingly, it is an object of the present invention to provide a fuse puller that eliminates the possibility of a shock hazard while expediting the removal and/or insertion of a fuse in the fuse support clips.

SUMMARY OF THE INVENTION

In accomplishing this and other objects, there is provided in accordance with the present invention, a cartridge fuse ejecting and injecting device including a fuse shroud having a base portion through which fuse retaining spring clips mounted on supporting surface are adapted to extend. The shroud is mounted for limited movement toward and away from the supporting surface on which the spring clips are mounted by means of an integral pedestal that extends outwardly the base portion of the shroud and through an opening in the supporting surface. The pedestal is loosely retained in the hole while shoulders or other suitable stop means are provided on the remote end of the pedestal to limit the movement of the pedestal.

When positioned in the spring clips the cartridge fuse is held in proper position to be engaged by an inside surface of the bottom wall of the shroud. Ejection of the fuse from its position between the spring clips is accomplished by pulling the loosely mounted shroud away from the support. The shroud has an integrally hinged cover with a longitudinal claw for gripping the fuse to a lesser degree than the fuse clips. The claw holds the ejected fuse for subsequent removal and is used to hold a replacement fuse in position for injection into the fuse clips after the cover and fuse is closed. The fuse is injected into the clips by returning the shroud and the closed cover with fuse to a mounted position on the mounting surface.

BRIEF DESCRIPTION OF THE DRAWINGS

A better understanding of the present invention may be had when the following detailed description is read in connection with the accompanying drawings in which.

DESCRIPTION OF THE PREFERRED EMBODIMENT

Detailed Description

Figure 1:
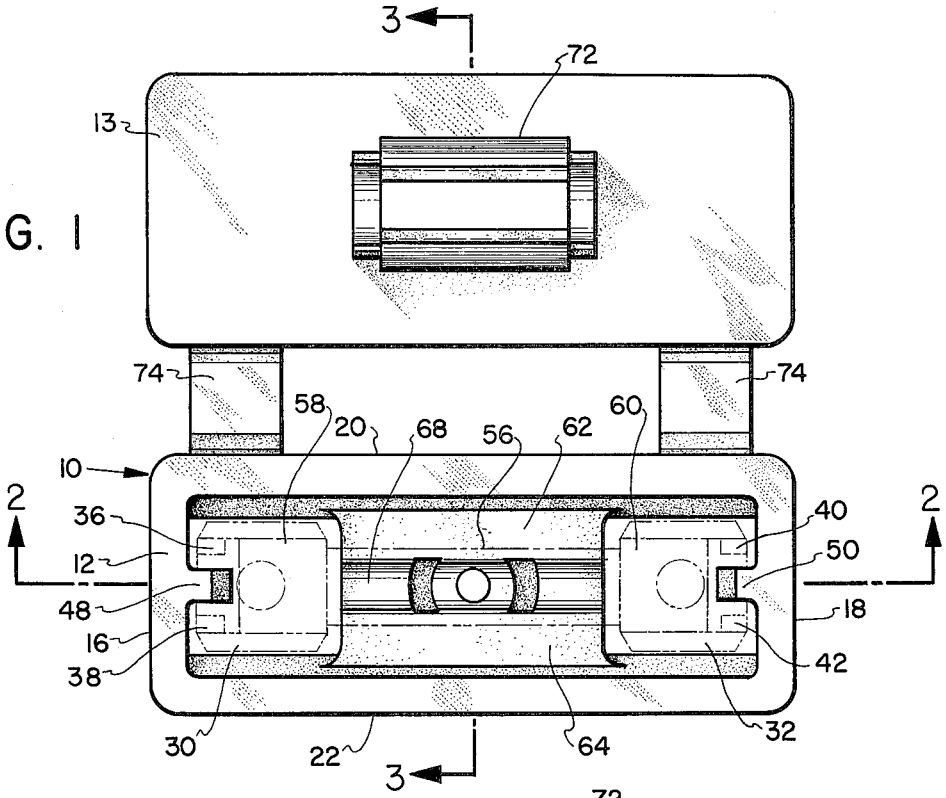
FIG. 1 is a top view of the fuse injector/ejector embodying the present invention.
Figure 2:
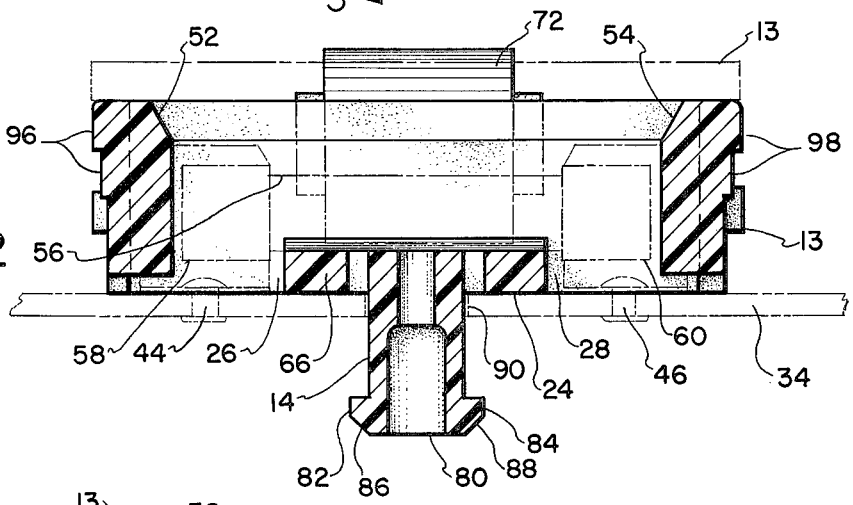
FIG. 2 is a sectional side view of the fuse injector/ejector shown in FIG. 1 taken along the line 2—2.
Figure 3:
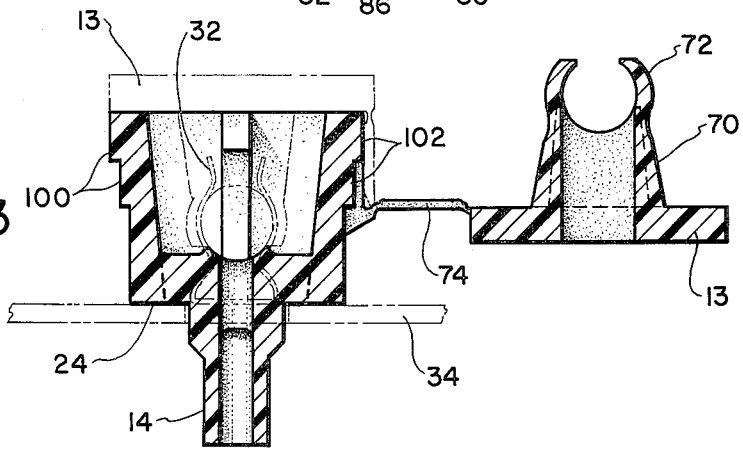
FIG. 3 is a sectional side view of the fuse injector/ejector shown in FIG. 1 taken along line 3—3.

Referring to FIGS. 1, 2, and 3 in more detail, there is shown a unitary fuse injector/ejector 10 which is composed of three major parts, namely, a shroud 12, a cover 13 and a self-anchoring tube, or pedestal, 14. The fuse injector/ejector 10 is preferably molded as a unitary structure of a suitable electrically insulating plastic material having semi-resilient characteristics, as for example a suitable polypropylene material.

The fuse shroud 12 is of a rectangular open top box-shaped configuration and has a pair of end walls 16, 18 forming the ends of the box, a pair of elongated side walls 20, 22 forming the sides of the box and a bottom wall 24 which forms a base of the box-shaped fuse shroud 12. The bottom wall 24 of the shroud 12 has a pair of spaced apart openings 26, 28 therein. Each of the openings 26, 28 are sized to allow a respective one of a pair of U-shaped spring clip fuse contacts 30, 32 to pass therethrough. The fuse contacts 30 and 32 are, in turn, shown mounted in a fixed position on a support board 34.

The spring clip fuse contacts 30, 32 which are surrounded by the shroud 12 are of a well-known type. These clip contacts 30, 32 are each shown having a pair of end stops 36, 38; 40, 42, respectively, at each of their outer ends. The base of each of the clip contacts 30, 32 is attached by a rivet 44, 46, respectively, to the support board 34. The clips 30, 32, the rivets 44, 46 and the board 34 are shown in a phantom representation in order not to obscure the showing of the fuse injector/ejector 10 and since their details do not form a part of the present invention.

The shroud 12 has a pair of fuse guide surfaces or tongues 48, 50 extending in an inward direction from the corresponding one of the end wall 16, 18. The upper ends of each of these tongues 48, 50 adjacent to the open top of the shroud 12 have a beveled surface 52, 54 tapering inwardly from the open top of the shroud 12. A cartridge type fuse 56 is shown in a phantom representation in FIG. 1. The respective conductive ends 58, 60 of the fuse 56 are held in the associated spring clip contacts 30, 32. The fuse 56 is shown extending between and in spaced relation with the tongues 48, 50. These tongues are sized and positioned to extend between the spring clip end stops 36, 38; 40, 42 formed on the associated spring clip contacts 30, 32 to form additional end stops for the fuse 56.

The inner surface of the bottom wall 24 of the shroud 12 has a pair of flat surfaces 62 and 64, extending inwardly from the elongated side walls 20 and 22, respectively, and a transverse fuse support 66 interconnecting the flat surfaces 62, 64. A concave, or arcuate-shaped, surface 68 is formed in the transverse fuse support 66 with a radius of curvature slightly larger than that of the transparent part of the fuse 56. This allows the transparent portion of the fuse 56 to loosely engage the concave surface 68 when the fuse 56 is mounted in the clips 30, 32, i.e., the surface 68 does not grip the fuse 56.

The cover 13, on the other hand, is provided with an outwardly extending longitudinal integral ridge 70 terminating in a claw 72 having an inside radius that is slightly smaller than the transparent portion of the fuse 56. Thus, the claw 72 is effective to grip the fuse 56 to an extent determined by the resiliency of the material forming the cover 13 and the integral ridge 70 and claw 72. The cover 13 is connected to the shroud body 12 by a hinge 74 which may be a self, or integral, hinge attached to the shroud body 12 on an outside surface of one of the side walls 20 and 22, e.g., wall 20, below the level of the open top of the shroud body 12.

As shown in FIG. 2, the outside surface of the bottom wall 24 has an attached self anchoring hollow tube, or pedestal, 14. An upper portion of the tube 14 is of substantially cylindrical configuration. The lower portion 80 of the tube 14 has a pair of outwardly extending integral lugs 82, 84 which have beveled lower edges 86, 88.

The lower portion 80 of the hollow tube 14, including the lugs 82, 84, may be compressed by the jaws of a pair of pliers (not shown). Such a compression of the lower end 80 of the tube 14 permits that end to be inserted through an opening 90 in the support board 34. Release of the compression after the end of the tube 14 has been inserted through the opening 90 allows that end of the tube to resume its initial configuration. The lugs 82, 84 then resume their normal position and extend beyond the edge of the opening 90 whereby the tube 14 with its lugs 82, 84 constitute a loosely coupled captive mounting for the injector/ejector 10. The outside surfaces of the end walls 16 and 18 and the side walls 20 and 22 may have a contoured surface to assist in grasping the shroud 12 to move it with respect to the board 35. As illustrated in the drawings of the preferred embodiment, these outside surfaces are arranged to taper outwardly from the bottom wall 24 are a series of steps, i.e., steps 96, 98, 100 and 102. Each step is continued around the shroud 12 to form a continuous surface.

MODE OF OPERATION

The fuse injector/ejector 10 is mounted on a support board 34 as described above, by using a pair of pliers or the like to compress the lugs 82, 84 and the wall of the end portion 80 of the tube 14, toward one another. While the lugs 82, 84 and the end portion 80 are thus compressed a sufficient amount to allow them to be inserted through the opening 90 in the support board 34, a force is applied to the shroud 12 toward the board 34. The compressed lugs 82, 84 and tube 14 are consequently inserted through the opening 90 in the support plate 34. After the compressive force is removed the natural resilient nature of the material of which the lugs 82, 84 and the tube 14 are made will allow these parts to resume the position they were in before they were compressed and therefore into the shroud retaining position as is shown in FIG. 2.

While the compressed hollow tube 14 is being moved through the support board 34, as just described, the openings 26, 28 in the bottom wall 24 of the shroud 12 will concurrently allow the U-shaped spring clips 30, 32 to be inserted therethrough. The loose captive mounting relationship of the shroud 12 with respect to the support board 34 prevents the shroud 12 from being separated from the board 34 a sufficient distance to allow the clips 30 and 32 from escaping from the openings 26 and 28.

INJECTION OF A FUSE

To inject, or insert, a fuse 56 into the spring clips 30, 32, the cover 13 is opened and the fuse 56 is first mounted and approximately centered in the claw 72. The cover 13 is, then, closed over the top of the shroud 12. This last operation is preferably performed with the shroud lifted off the board 35 on the pedestal 14 to the maximum distance permitted by the tabs 82 and 84. In this way, the closing of the cover 13 with the captive fuse 56 avoids a concurrent interaction between the fuse 56 and the spring clips 30 and 32. After the cover 13 is closed, a force is applied on the outside surface of the cover 13 while the shroud 12 is released. This force on the cover 13 and shroud 12 moves them toward the board 35 and the fuse 56 is forced into the clips 30 and 32. The beveled surface 52 and 54 operate to guide the fuse 56 into clips 30 and 32 in the event that the fuse 56 was not precisely centered in the claw 72. When the fuse 56 is retained by the spring clips 30 and 32, the fuse 56 retains the shroud 12 against the board 35 by pressing against the internal longitudinal depression 68 in the bottom wall 24. Further, the cover 13 is maintained in a closed state by the gripping action of the claw 72 on the fuse 56.

On the other hand, the injector/ejector 10 may also be operated to insert a fuse 56 into the clips 30 and 32 with the shroud 12 pressed against the board 34. In this type of operation, the entire insertion of fuse 56 into the clips 30 and 32 is performed by the closing of the cover 13. The hinge 74 is provided with sufficient flexibility to allow the fuse to enter the clips 30 and 32 during the closing of the cover 13 although the cover 13 may have to be manipulated to a greater degree than the simple close and push technique described in the preferred form of the injection operation. Ultimately, however, the cover 13 is similarly held closed by the gripping action of claw 72 and the shroud 12 is concurrently retained against the board 35 by the fuse 56 held in the clips 30 and 32.

EJECTION OF A FUSE

To eject the fuse 56 from its previously inserted position between the spring clips 30, 32, it is merely necessary to grasp either the end walls 16 and 18 or the side walls 20 and 22 by means of the steps 96, 98; 100, 102 and to then pull the shroud 12 and attached closed cover 13 in a direction away from the support board 34.

The concave surface 68 of the shroud 12 will as the shroud is attempted to be lifted past the spring clips 30 and 32 and fuse 56, exert an immediate force against the fuse 56 causing the entire fuse 56 to be forced from its position in which it is clamped by the spring clips 30 and 32. During this operation, the fuse 56 will continue to be gripped by the claw 72. When the fuse 56 is finally disengaged from the spring clips 30 and 32 by a continued lifting of the shroud 12 to the extent allowed by the tabs 82 and 84, the cover 13 is free to be opened to provide access to the ejected fuse 56. However, the fuse 56 is still held by the claw 72 which obviates the tendency of the fuse to pop out of the fuse clips 30 and 32 in an uncontrolled manner. The ejected fuse can then be removed from the claw 72 and replaced and/or inspected.

Employing an injector/ejector 10 of the present invention to eject the fuse in the aforementioned manner therefore eliminates the need for the use of any ancillary tool, e.g., a screwdriver, such as has heretofore been improperly used with prior art fuse ejecting devices to pop these fuses out of their associated clips. Since no fuse popping action occurs in the use of the fuse ejecting shroud 12, the danger of an operator being hit in the face with a fuse that has been shattered or popped out of its clips by means of a screwdriver is eliminated. Further, the cover 13 may be provided with a fuse identifying legend (not shown) on its external surface. Additionally, the shroud 12 and/or the cover 13 may be provided with access holes for inspection and/or testing of the fuse 56. Finally, it should be noted that since the grip of the claw 72 on the fuse 56 is significantly less than the grip of the spring clips 30 and 32 on the fuse ends, the cover 13 may be opened and closed for inspection of the fuse 56 without disturbing the fuse 56 from its mounted position in the clips 30 and 32.

Thus it may be seen that there has been provided an improved combination fuse injector and ejector wherein no ancillary tool is required for either removing or installing a fuse in its spring clip mounting, and wherein injury to an operator is avoided and protection for the mounted fuse is provided.

The embodiments of the invention in which an exclusive property or privilege is claimed are defined as follows:

1. A fuse injector/ejector for use in association with a pair of spaced apart spring clip contacts for a cartridge type fuse, said clip contacts being mounted on a suitable support base to receive a fuse therebetween, said injector/ejector comprising:

a fuse shroud partially surrounding the clip contacts and having an open top and side and end walls of sufficient height to be at least coextensive with the spring clip contacts;

said fuse shroud further having a bottom wall with a pair of spaced apart openings adapted to receive said clip contacts and an interior bottom wall surface between said clip contacts arranged to be adjacent to a fuse mounted in said clip contacts;

a mounting pedestal attached to an exterior bottom wall surface and extending outwardly in a direction opposite from the direction of extension of said side walls and adapted to be inserted through a suitable opening in the support base for loose captive mounting therein to permit movement of said fuse shroud between a first position and a second position;

whereby to permit a cartridge fuse to be inserted between said clip contacts when said shroud is seated on said support base in said first position and whereby said interior surface ejects a mounted fuse from between both of said clip contacts when said shroud is lifted from said support base to said second position;

a shroud cover means arranged to cover at least a portion of said open top; and a claw means mounted on an inside surface of said cover and arranged to grip a fuse to a lesser degree than the clip contacts, said claw means gripping the fuse when said shroud cover is closed and the fuse is mounted in said clip contacts and continuing to grip the fuse after the fuse has been ejected from said clip contacts by the movement of the shroud to said second position.

2. A fuse injector/ejector as set forth in claim 1 wherein said shroud cover means includes a hinge means arranged to flexibly connect said shroud cover means to said fuse shroud.

3. A fuse injector/ejector as set forth in claim 1 wherein said fuse shroud, said mounting pedestal and said shroud cover means are molded of a semi-resilient material.

4. A fuse injector/ejector as set forth in claim 3 wherein said interior surface includes a concave surface arranged for engagement with the fuse when said shroud is lifted from the support base.

5. A fuse injector/ejector as set forth in claim 1 and including guide tongues mounted on the inner surface of each of said end walls to guide the ends of the fuse into longitudinal position relative to said clip contacts.

6. A fuse injector/ejector as set forth in claim 2 wherein said fuse shroud, said mounting pedestal, said hinge means, said claw means and said shroud cover means are integrally molded from a semi-resilient electrically insulating material.

7. A fuse injector/ejector as set forth in claim 1 wherein said pedestal includes at a free end outwardly extending ears arranged to interfere with the opening in the support base to provide the loose captive mounting of said fuse shroud.

8. A fuse injector/ejector for use in association with a pair of spaced apart spring clip contacts for a cartridge type fuse, said clip contacts being mounted on a suitable support base to receive a fuse therebetween, said injector/ejector comprising a fuse shroud means partially surrounding the spring clip contacts and a fuse mounted therebetween, said fuse shroud means having a bottom wall with a pair of spaced apart openings adapted to allow said clip contacts to pass therethrough and an interior bottom wall surface between said spaced apart openings arranged to be adjacent to a fuse mounted in said clip contacts, whereby to permit a cartridge fuse to be inserted between said clip contacts when said shroud means is seated on said support base and to eject a mounted fuse from between both of said clip contacts by said interior surface when said shroud means is lifted from said support base, shroud cover means carried by said fuse shroud means and arranged to cover at least a portion of a fuse mounted in said clip contacts and a claw means mounted on an inside surface of said cover means and arranged to grip a fuse to a lesser degree than the clip contacts, said claw means being arranged to grip the fuse when said shroud cover means is positioned to cover said portion of a fuse mounted in said clip contacts and when the shroud cover means is positioned to cover said portion of a fuse that is free of said clip contacts.

9. A fuse injector/ejector as set forth in claim 8 wherein said shroud cover means includes a hinge means arranged to flexibly connect said shroud cover means to said fuse shroud means.

10. A fuse injector/ejector as set forth in claim 9 wherein said interior surface includes a concave surface arranged for engagement with the fuse mounted between said clip contacts when said shroud means is lifted from the support base.

11. A fuse injector/ejector as set forth in claim 8 and further including a mounting pedestal means attached to an exterior bottom wall surface and extending outwardly from said exterior bottom wall surface and adapted to be inserted through a suitable opening in the support base for loose captive mounting therein to permit movement of said fuse shroud means between a first position when said fuse shroud means is seated on said support base and a second position when said fuse shroud means is lifted from said support base to eject a fuse from said clip contacts.

12. A fuse injector-ejector as set forth in claim 11 wherein said shroud cover means includes a hinge means arranged to flexibly connect said shroud cover means to said fuse shroud means and wherein said fuse shroud means, said shroud cover means, said pedestal means and said claw means are integrally molded of a semi-resilient electrically insulating material.

13. A fuse injector/ejector as set forth in claim 9 wherein said fuse shroud means, said shroud cover means, said hinge means and said claw means are integrally molded of a semi-resilient electrically insulating material.

* * * * *